US006470999B1

(12) United States Patent
Schanzle

(10) Patent No.: US 6,470,999 B1
(45) Date of Patent: Oct. 29, 2002

(54) ERGONOMIC INSERT FOR AERIAL BUCKET

(76) Inventor: Philip Hart Schanzle, 1155 Brussels St., San Francisco, CA (US) 94134

( * ) Notice: Subject to any disclaimer, the term of this patent is extended or adjusted under 35 U.S.C. 154(b) by 0 days.

(21) Appl. No.: 09/677,974

(22) Filed: Oct. 2, 2000

(51) Int. Cl.[7] ..... B66F 11/04
(52) U.S. Cl. ..... 182/2.1; 182/129
(58) Field of Search ..... 182/2.1–2.11, 129

(56) References Cited

U.S. PATENT DOCUMENTS

| | | | |
|---|---|---|---|
| 3,404,751 | A | 10/1968 | Nosworthy |
| 4,763,758 | A | 8/1988 | Moody |
| 4,883,145 | A | 11/1989 | Deltatto |

OTHER PUBLICATIONS

Author Unknown–Company Form; Bucket Liners with Molded Step; Form; Feb, 1, 1997; page unknown; Form #1016 Rev. D; Plastic Techniques, Inc.; Goffstown, NH; U.S.A.

Author Unknown–Company Flyer ; Hanging Thigh Brace/ Tool Tray; Company Flyer; Date Unknown (Earlier Than Effective U.S. Filing Date); No page, volume or issue Numbers; Plastic Composites Corp.; Fort Wayne, Indiana, U.S.A.

*Primary Examiner*—Alvin Chin-Shue
(74) *Attorney, Agent, or Firm*—Bernard A. Bartfeld

(57) ABSTRACT

An ergonomic insert is disclosed that reduces the risk of low-back injury to workers in aerial buckets. A combination of an ergonomic insert, an aerial bucket and means for stabilizing said ergonomic insert within the aerial bucket is also disclosed. Finally, a method for using such an ergonomic insert is also disclosed. The ergonomic insert comprises a nominally non-deformable material having foot-receiving surfaces and capable of bearing a worker's weight. Various means for supporting the ergonomic insert in a vertical position are disclosed. The method for using the ergonomic insert comprises placing the ergonomic insert into the aerial bucket from above. The ergonomic insert is positioned between the worker and the work to be performed. The worker then places a foot on one of the foot receiving surfaces prior to or while performing the work.

16 Claims, 6 Drawing Sheets

ERGONOMIC INSERT FOR AERIAL BUCKET

BACKGROUND OF THE INVENTION

1. Field of Use

The present invention relates to aerial buckets. Aerial buckets are elevated work platforms. They are also referred to as aerial baskets or cherry pickers. They are well established in the art and are useful for tree trimming, fruit picking, maintaining and installing utility lines and for any other purpose where a worker must be elevated. Aerial buckets are usually attached to a boom which in turn is mounted on the back of a truck.

2. Description of the Prior Art

Concern for worker safety and efficiency has prompted manufacturers to introduce improvements and additions to the basic bucket design. For example, some aerial buckets are made of a dielectric material to prevent electrocution of the worker if the bucket should accidentally contact a live electric line. Dielectric bucket liners have been added to decrease the chance of electric shock even further. Some buckets and bucket liners have an inner step to facilitate exiting of the bucket. U.S. Pat. No. 3,404,751 discloses and Plastic Techniques, Inc. of Goffstown, N.H. builds bucket liners with a molded step to facilitate egress from aerial buckets. Such designs, however, do not take into account the ergonomic needs of the worker while the worker is performing the work.

It is well known in the art that a worker can reduce lower back strain by resting one foot in front of the other on a raised surface. Buckets and liners have been designed with such a raised surface as an integral part of the bucket or liner. U.S. Pat. No. 4,883,145 discloses an ergonomic aerial bucket in which the floor of the aerial bucket is surround by a raised platform adapted to receive one foot of a worker. However, such a raised platform, being in a fixed position, do not provide for adjustment by the worker, so that the worker can choose the most advantageous position for the job at hand. In addition, such designs do not address the problem of retrofitting a bucket or liner that does not have such a step.

To address the retrofitting problem, advertising by Plastic Composites Corporation of Fort Wayne, Ind. (PCC) discloses an insertable ergonomic support. The PCC device allows a worker to lean his thighs against it and does not provide support for one foot to be raised above the other. Instead both feet rest at the same level on the floor of the aerial bucket. U.S. Pat. No. 3,404,751, an Aerial Bucket Step, also discloses a demountable step, however its sole purpose is to facilitate egress from the aerial bucket. In addition, these two devices are limited to providing support only at the walls of the bucket. Support elsewhere in the bucket, for example at the center of the bucket, is not available.

All of the above described improvements and additions are further limited in that they provide at most one level on which a worker can place a foot higher than the other. However, workers are of differing heights, have differing musculature and orthopedic problems. Different tasks require different positions for the worker and the bucket, and only the worker on the job can know which task he or she will be performing from moment to moment. Thus maximum efficiency and safety may best be achieved by providing foot-receiving surfaces at varying heights and locations within the bucket, allowing the worker to choose, from moment to moment, where to place his or her raised foot.

Some embodiments of the present invention include the use of a palette board. Palette boards are well known in the transportation industry. Their prior art use is as a platform for stacking and moving merchandise with a fork lift. Prior to the present invention, the use of palette boards as ergonomic inserts for aerial buckets has not been suggested.

OBJECTS OF THE INVENTION

In order to satisfy the foregoing needs, it is an object of the present invention to provide an aerial bucket insert which provides a plurality of heights and horizontal locations for foot receiving surfaces.

It is a further object of the present invention to make it easy to place into and remove from an aerial bucket the ergonomic insert of the present invention.

A further object of the present invention is to use the walls of the bucket to provide support and stability for the insert.

A further object of the present invention is to provide for the insert to take up a small amount of floor space so that the worker is able to move within the bucket with relative freedom.

A further object of the present invention is to provide for the insert to be light enough so that the worker may change its position from within the bucket, thus providing maximum convenience and choice to the worker.

A further object of the present invention is to facilitate egress from the aerial bucket.

SUMMARY OF THE INVENTION

To meet the objects of the present invention, an ergonomic insert designed for use within an aerial bucket is disclosed. A combination of an ergonomic insert, an aerial bucket and means for stabilizing said ergonomic insert within the aerial bucket is also disclosed. Finally, a method for using an ergonomic insert is disclosed. The ergonomic insert of the present invention provides at least one foot receiving surface for a worker to place a foot above and in front of the other in order to reduce the risk of lower back injury.

Features of the present invention include at least one sheet of material capable of bearing a worker's weight. Additionally, the ergonomic insert slides into the aerial bucket from above and is then supported in position by alternative means within the aerial bucket or bucket liner. The foot receiving surfaces are formed in suitable shapes and sizes to allow the worker's foot to rest comfortably on the exposed surface of the insert within the hole. The term "footrest" as used herein is meant to include all foot-receiving surfaces.

When there are a plurality of footrests, they may be placed at various heights and, from the worker's perspective, on the left and right sides of the insert to allow the worker the maximum freedom of choice. The height of the ergonomic insert of the present invention may allow the worker to easily step over the insert so he can work on either side of it. Finally, the ergonomic insert of the present invention provides easier egress from said bucket by providing a foot-receiving surface so that worker can use his legs to climb out of the aerial bucket.

DETAILED DESCRIPTION OF THE INVENTION

Figure 1:
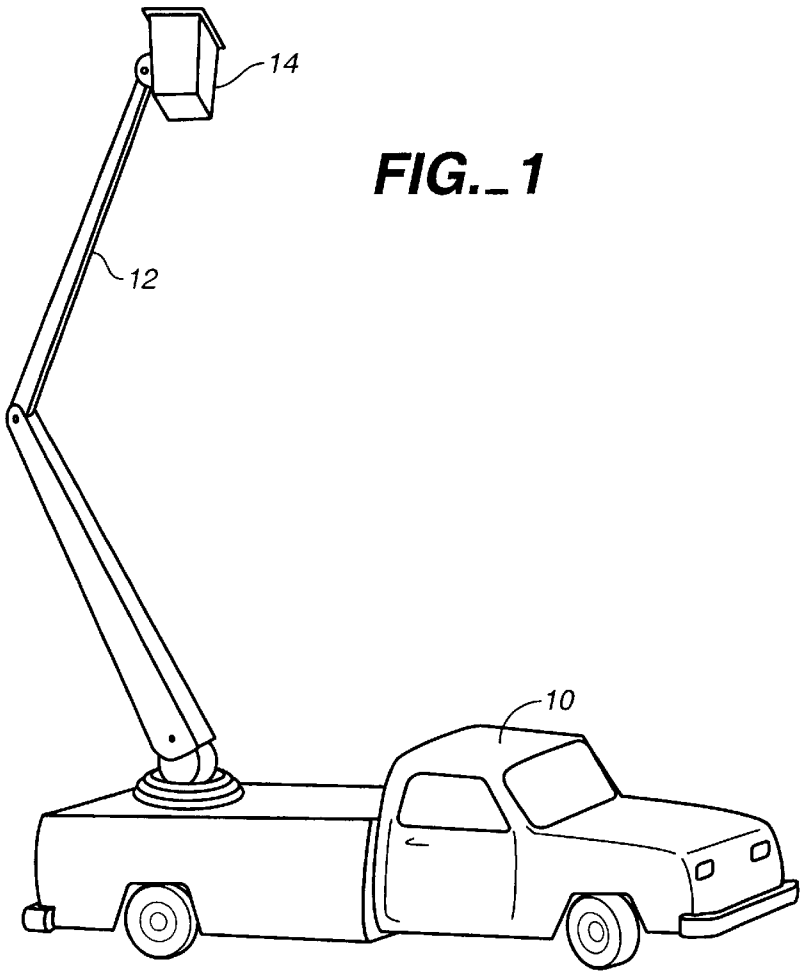
FIG. 1 is a perspective view of an aerial bucket attached to a self-propelled vehicle via a boom.

Referring to the drawings in detail, the present invention is adapted for use in an aerial bucket 14 as shown in FIG. 1. Generally, an aerial bucket 14 is attached to a self-propelled vehicle 10 by means of a boom 12 and usually has a bucket liner. Bucket liners are usually made of a non-conductive material, designed to closely fit within an aerial bucket. It is understood that references herein to aerial buckets include references to aerial buckets that contain bucket liners. For example, language that indicates the placing of an insert within an aerial bucket is meant to also indicate the placing of an insert within a liner for an aerial bucket when the aerial bucket is equipped with a liner. In addition, terms that refer to the parts of aerial buckets are meant to signify the corresponding part of liners for those aerial buckets equipped with liners. For example, reference to the walls, dimensions or design of an aerial bucket refer to the walls, dimensions or design of the liner within the aerial bucket for those buckets equipped with a liner.

Figure 2:
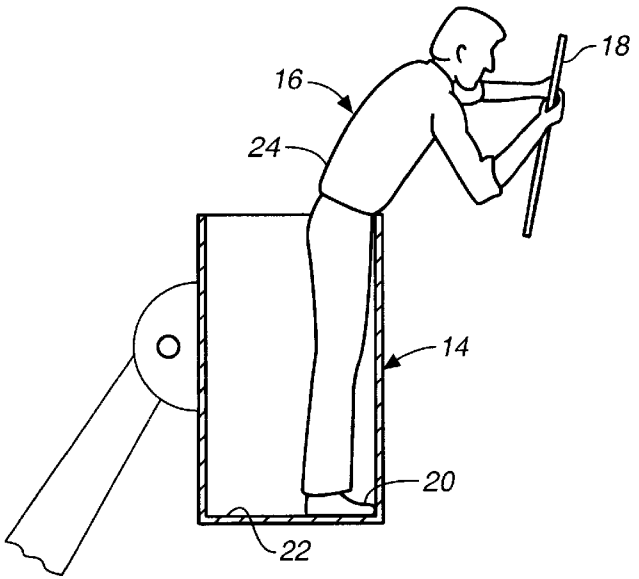
FIG. 2 (PRIOR ART)
FIG. 2 is a side view of a worker performing work in an aerial bucket without an ergonomic insert as in the prior art.

Most aerial buckets used today simply have walls and a floor, with no place for a worker to rest one foot higher than another. For example, FIG. 2 shows a worker 16 performing manual labor from within an aerial bucket 14. Worker 16 is leaning forward to grasp an object such as a tool 18 while he has both feet 20 on floor 22 of aerial bucket 14. This placement of feet 20 while bearing weight in the hands and leaning forward places a strain upon lower back 24 of worker 16.

It is well known in the field of ergonomics that positioning one foot slightly higher and in front of the other provides a biomechanical advantage to the lower back thus helping to lower the risk of lower back injuries. Accordingly, as shown in FIGS. 3, 4 and 4A, the present invention, an ergonomic insert 26, alleviates much of the strain upon lower back 24 of worker 16 by providing footrests 34 for a worker 16 to rest one foot 20A above and in front of other foot 20B.

To support the weight of a worker, the ergonomic insert of the present invention may be made of any nominally non-deformable material including such materials as a somewhat flexible rubber or a relatively rigid wood. A preferred embodiment of the present invention may be made of a lightweight, nonconducting material with high dielectric strength that does not absorb water and is resistant to corrosion. Such materials are well known in the art and include some plastic compounds.

Figure 3:
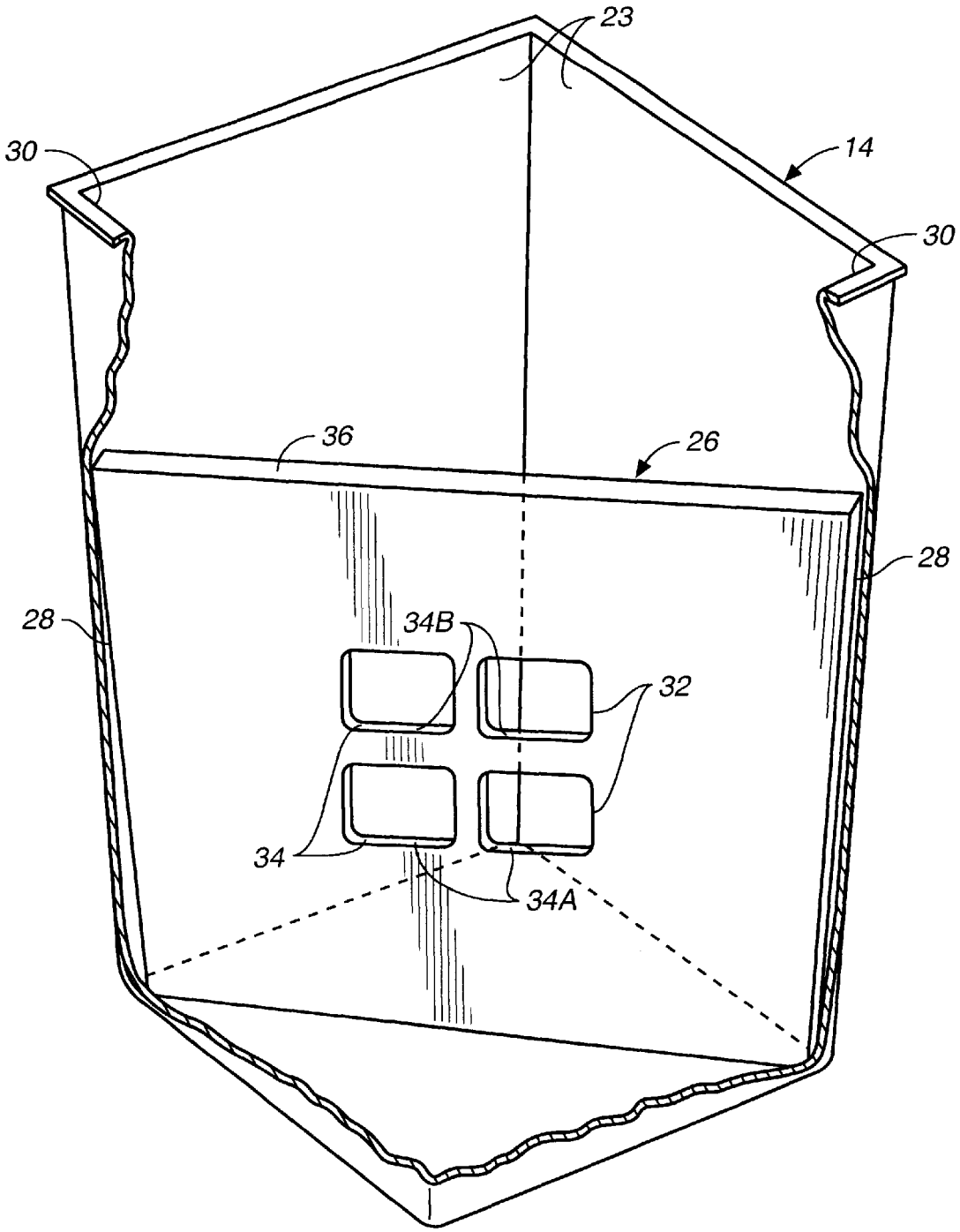
FIG. 3 is a perspective cutaway view of an ergonomic insert of the present invention within an aerial bucket.
Figure 4:
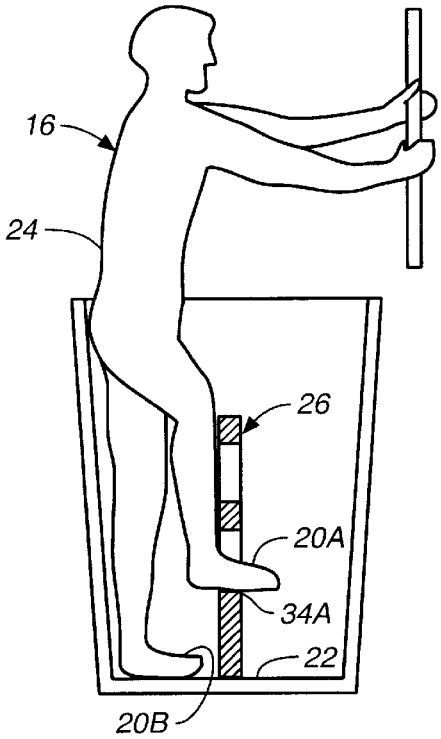
FIG. 4 is a side view of a worker performing work in an aerial bucket while placing a foot on a lower footrest of an ergonomic insert of the present invention.

FIG. 3 illustrates a generic ergonomic insert 26. Insert 26 is constructed with a plurality of holes 32 therein, wide enough to accommodate the width of a human foot, thus providing a plurality of footrests 34. It is understood, however, that an ergonomic insert according to the present invention may simply have one footrest or a top edge on which to rest a foot.

The terms "ergonomic place" and "ergonomically placed" refer to the proper placement of an insert in an aerial bucket. The terms "ergonomic position" and "ergonomically positioned" refer to the positioning of a footrest on or in an ergonomic insert so that the footrest is of at least nominally effective height and lateral position to help reduce the risk of lower back injury when the insert is ergonomically placed within an aerial bucket. To achieve nominal protection for the lower back, the height at which worker's foot 20A should be placed, and thus the ergonomic positions of the footrests and ergonomic placement of the insert depend on several factors. These factors include the physiology of the individual worker 16, including the prior condition of his back, his flexibility and his height. For example, for most workers between the height of 5'0 and 6'6", a footrest is ergonomically positioned when it is a minimum of six inches and a maximum of twenty two inches above the floor of the aerial bucket. Other factors that affect ergonomic position include the location of the aerial bucket in relation to the work, and the nature of the work to be performed.

The above factors and the natural need to change positions after extended periods in one position influence whether worker 16 should raise the left or right foot.

Because optimal placement of the worker's foot is variable, a preferred embodiment of the present invention has footrests ergonomically positioned on at least two different heights so that a worker may choose different heights in which to place a foot. In addition, a preferred embodiment has footrests 34 ergonomically positioned on both the left and right of insert 26 to allow worker 16 to choose either his left or right foot to place in a footrest 34.

Insert 26, for example has a pair of lower footrests 34A, a pair of upper footrests 34B, and a top edge 36 all of which may act as footrests and may also be used to facilitate egress from aerial bucket 14. Thus a worker using such an insert may place either foot in front of and higher than the other foot at three different heights. For a typical worker, one embodiment of the present invention that facilitates egress from the aerial bucket 14 comprises a top edge 36 that is between one and two thirds the height of the walls 23 of the aerial bucket 14.

Figure 4B:
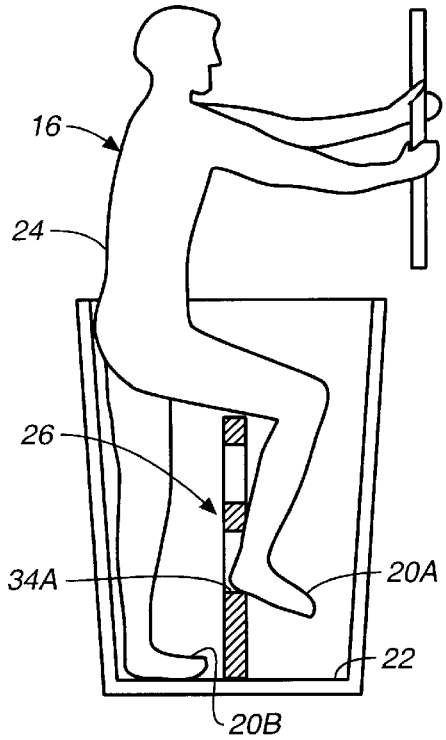
FIG. 4B is a side view of a worker performing work in an aerial bucket while placing a foot on a lower footrest of an ergonomic insert of the present invention.
Figure 4A:
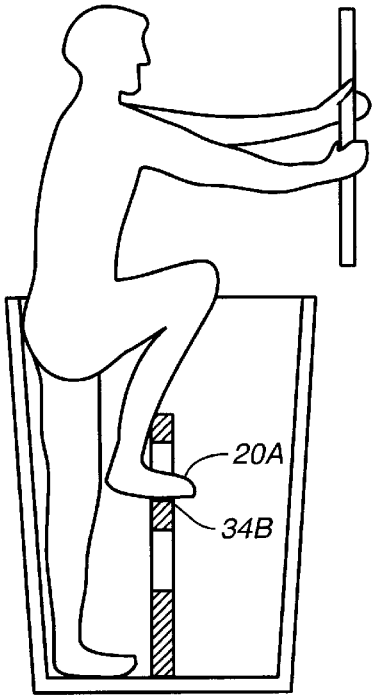
FIG. 4A is a side view of a worker performing work in an aerial bucket while placing a foot on an upper footrest of an ergonomic insert of the present invention.

The placement of a worker's foot 20A at different heights is best shown in FIGS. 4 and 4A through 4C. In FIG. 4, worker 16 is performing manual labor from within an aerial bucket 14 containing an ergonomic insert 26. In FIGS. 4 and 4B, to protect lower back 24, worker 16 has a first foot 20A on a lower footrest 34A of insert 26 and a second foot 20B on floor 22. Insert 26 bisects aerial bucket 14 and is low enough to allow worker 16 to step over insert 26 to stand on either side of it. Additionally, footrests 34A and 34B are shaped to allow a foot 20 to be inserted from either side of insert 26. Thus worker 16 can utilize the benefits of insert 26 while standing on either side of insert 26 as appropriate for the work to be performed. For further support and stability, in some smaller aerial buckets a worker may push his raised knee into the corner 30 closest to the raised knee.

Figure 4C:
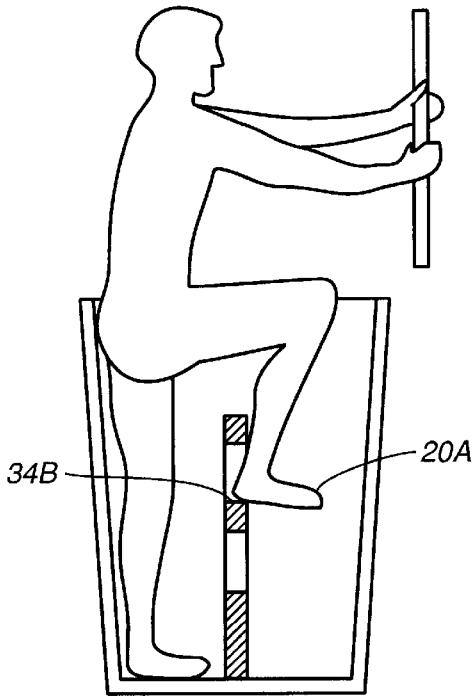
FIG. 4C is a side view of a worker performing work in an aerial bucket while placing a foot on an upper footrest of an ergonomic insert of the present invention.

In FIGS. 4A and 4C worker 16 is performing manual labor with first foot 20A on upper footrest 34B while second foot 20B rests on floor 22. Because there are a plurality of footrests, worker 16 has the option to choose either the left or right foot to be raised as well as the option to choose various heights to place the raised foot 20A. This embodiment of the present invention thus allows worker 16 to choose the most comfortable and ergonomically beneficial position to protect lower back 24.

To encourage the use of ergonomic inserts 26, the present invention may be constructed to be quickly and easily ergonomically placed within an aerial bucket 14 without attaching means, such as clamps or rope. In fact, when the ergonomic insert of the present invention has stabilizingly insertable dimensions, placement of the ergonomic insert 26 can occur in one step. Thus, ergonomic insert 26 may be constructed or selected so it slides into place from above and is supported in a nominally vertical ergonomic position by walls 23 of bucket 14. Accordingly, in FIG. 3, ergonomic insert 26 is placed within aerial bucket 14 in such a manner that side edges 28 of insert 26 stabilizingly engage inside corners 30 of aerial bucket 14. Inside corners 30 act as a slot into which insert 26 may be lowered in one motion. Insert 26 thereafter cannot substantially move from its position until worker 16 lifts it out of aerial bucket 14 at the end of the workday.

The term "stabilizing side edges" is defined as the vertical side edges of an ergonomic insert where the side edges are capable of stabilizingly engaging the wall or walls of an aerial bucket. The term "stabilizing width" is defined as a width for an aerial insert that matches the interior of an aerial bucket closely enough to allow the insert's side edges to be stabilizing side edges. Aerial buckets come in various shapes and sizes. As described in detail below and shown in the accompanying figures, the features described above may be adapted in other embodiments of the present invention to provide the same functionality with a wide variety of aerial bucket designs.

Figure 5B:
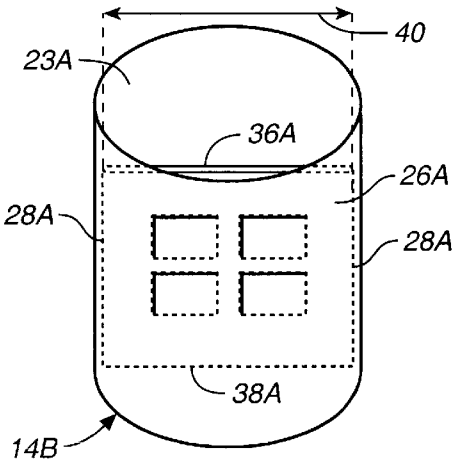
FIG. 5B is a perspective view of the ergonomic insert of FIG. 5 within a cylindrical aerial bucket.
Figure 5A:
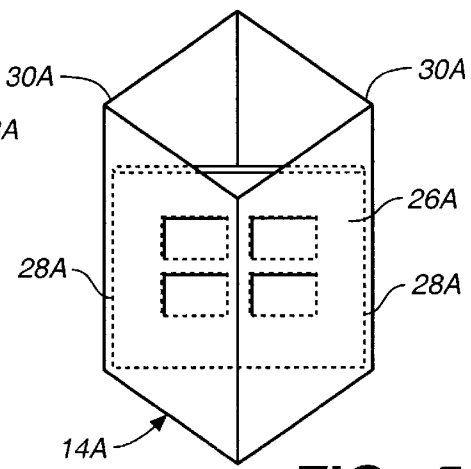
FIG. 5A is a perspective view of the ergonomic insert of FIG. 5 within a box-shaped aerial bucket.
Figure 5:
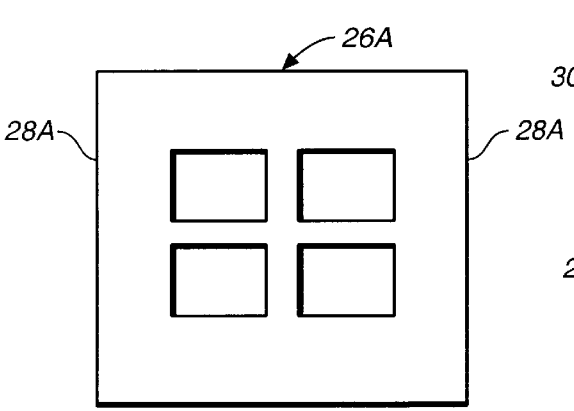
FIG. 5 is a front view of an ergonomic insert with parallel vertical edges according to one embodiment of the present invention.

For example, to achieve one-step placement of the ergonomic insert it is preferred that each model of ergonomic insert be constructed to fit into a particular aerial bucket design. One design, shown in FIG. 5, is an ergonomic insert 26A with vertical side edges 28A. Such an ergonomic insert 26A would fit into an aerial bucket with vertical walls and a nominally rectangular floor, as shown in FIG. 5A; a nominally circular floor as shown in FIG. 5B; or a nominally oval floor. It is understood that a square is a type of rectangle. Under certain conditions, discussed below, walls 23 of an aerial bucket 14 of irregular shape may also function to support ergonomic insert 26 in place.

To design an ergonomic insert to fit into a particular type of aerial bucket, side edges 28 of insert 26 may have a slope that matches the slope of inside corners 30 or walls 23 of aerial bucket 14. For example, FIG. 5 shows an insert 26A designed with vertical side edges 28A. Thus insert 26A best fits into aerial buckets with vertical inside corners, such as rectangular bucket 14A shown in FIG. 5A or vertical walls, such as cylinder-shaped bucket 14B such as that shown in FIG. 5B.

In a rectangular bucket 14A, the placement of insert 26A may occur along either of the two longest diagonal dimensions, that is, the diagonal between two diagonally opposite corners 30A. To enable walls 23 to support insert 26A, insert 26A may be constructed to be slightly less long than the longest diagonal in aerial bucket 14A. When insert 26A is placed between two diagonally opposite corners 30A, walls 23A support insert 26A by stabilizingly engaging side edges 28A of insert 26A. In addition, diagonally opposite corners 30A act like a slot suitable for receiving ergonomic insert 26A. When worker 16 slides insert 26A into place from above, it cannot be substantially displaced in any direction except vertically when worker 16 wishes to lift insert 26A out of bucket 14A.

A generic representation of a bucket with vertical walls 23A but no distinct corners is shown in FIG. 5B. Insert 26A in this case may be placed along any diameter 40. Diameter 40 is defined as a line bounded by walls 23A substantially longer than any adjacent parallel line bounded by walls 23A. It is preferred that side edges 28A stabilizingly engage wall 23A at opposite sides of diameter 40. Thus, it is preferred that insert 26A be selected or constructed to be slightly less wide than diameter 40. When such selection or construction occurs, insert 26A comprises both a stabilizing width and stabilizing side edges.

When worker 16 slides insert 26A into place, vertical stabilizing side edges 28A of insert 26A substantially abut walls 23A of bucket 14B. Insert 26A is placed so that it's bottom edge 38A runs along line 40. A stabilizing engagement between stabilizing side edges 28A and walls 23A occurs in part because of the inward curvature of walls 23A. For example, an embodiment of a bucket with walls but no inside corners would be cylinder-shaped. In the case of a cylinder shape, insert's top edge 36A and bottom edge 38A run along a diameter 40 of bucket 14B. Diameter 40 is longer than any adjacent parallel line within bucket 14B. Thus walls 23A curve inward as they move away from diameter 40. Because insert 26A is substantially as wide as diameter 40, insert 26A is prevented from falling by the inward curve of walls 23A. In a cylinder, insert 26A may be rotated by worker 16 as appropriate to the work to be performed. However, insert 26A will remain vertical and cannot otherwise be substantially displaced except when worker 16 wishes to lift insert 26A out of aerial bucket 14B.

There are other shapes that have substantially parallel walls but no corners. Insert 26A can be supported by walls 23A of buckets of such shapes, so long as they have a diameter 40 as defined above and walls 23A curve substantially inward as they curve away from the diameter and so long as insert 26A is of the proper stabilizing width and is properly placed as described above. For example, another embodiment of an aerial bucket with vertical walls but no corners would be oval-shaped In an oval-shaped bucket there are inherently only 2 axes which may serve as a "diameter" as defined above.

By the definitions of "longest diagonal" and "diameter" used herein, it is understood that a "longest diagonal" is a type of "diameter." So long as an aerial bucket 14 has a diameter and walls 23 curve inward at a steep enough angle, ergonomic insert 26 and walls 23 can stabilizingly engage to support ergonomic insert 26 in a an ergonomic place within said bucket.

As mentioned above, it is preferred that side edges 28 of insert 26 have a slope that matches the slope of inside corners 30 or walls 23 of aerial bucket 14. For example, FIG. 6 shows an insert 26B designed with side edges 28B that slope outward as they rise. Thus insert 26B best fits into aerial buckets with corners or walls that have the same slope, such as the aerial buckets in FIGS. 6A and 6B respectively.

Placement of insert 26B into aerial bucket 14C is similar to placement of insert 26A into aerial bucket 14A as described above. However, because of the slope of insert 26B, top edge 36B is longer than bottom edge 38B. Nevertheless, a preferred placement of insert 26B in a rectangular bucket with corners 30B that slope outward is along the longest diagonal dimension of any particular horizontal plane, that is between any two opposite corners 30B. As best shown in FIG. 6A, it does not matter which particular horizontal plane is used as a referent; placement of insert 26B is the same, whether one looks at the horizontal plane in which bottom edge 38B rests or the horizontal plane in which top edge 36B rests.

To enable walls 23 to support insert 26B, insert 26B may be constructed so that its bottom edge 38B is slightly less long than the diagonal between inside corners 30B along the plane of the floor of aerial bucket 14C, and top edge 36B is slightly less long than the diagonal between inside corners 30B along horizontal plane shared by top edge 36B when insert 26B is properly placed. When constructed in such a manner, insert 26B then comprises a stabilizing width and stabilizing vertical side edges.

When insert 26B is placed between two diagonally opposite corners 30B, walls 23A support insert 26B by stabilizing engagement with side edges 28B of insert 26B. Because insert 26B is slightly less wide than the distance between two diagonally opposite corners 30B, diagonally opposite corners 30B act like a slot suitable for receiving ergonomic insert 26B. When worker 16 places insert 26B between two diagonally opposite corners 30B, insert 26B cannot be substantially displaced in any direction except vertically when worker 16 wishes to lift insert 26B out of bucket 14B.

Figure 6B:
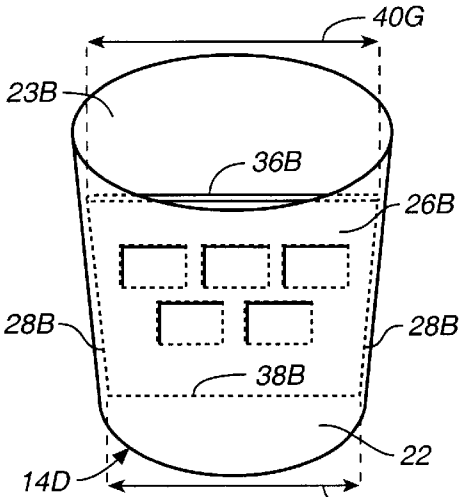
FIG. 6B is a perspective view of the ergonomic insert of FIG. 6 within an aerial bucket shaped like the frustum of a cone.
Figure 6A:
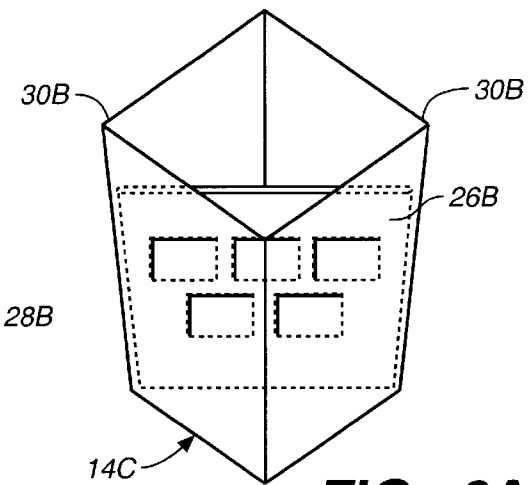
FIG. 6A is a perspective view of the ergonomic insert of FIG. 6 within an aerial bucket that has sloping corners.
Figure 6:
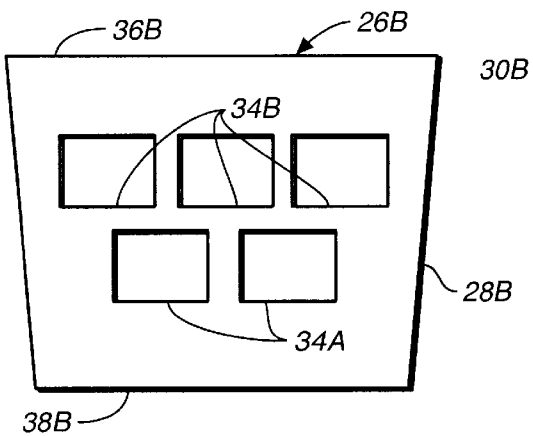
FIG. 6 is a front view of an ergonomic insert of the present invention with sloping stabilizing side edges according to another embodiment of the present invention.

A generic representation of a bucket with sloping walls 23B but no distinct corners is shown in FIG. 6B. A preferred placement of insert 26B in this case is with bottom edge 38B adjacent to any lower diameter 40L and top edge 36B along a greater diameter 40G directly above lower diameter 40L. Lower diameter 40L is defined as a line along floor 22 bounded by walls 23B substantially longer than any adjacent parallel line along floor 22 bounded by walls 23A. Greater diameter 40G is defined as a line along the horizontal plane in which top edge 36B comes to rest when insert 26B is properly placed within aerial bucket 14D, where such a line is bounded by walls 23B and is substantially longer than any adjacent parallel line in the same horizontal plane.

It is preferred that side edges 28B stabilizingly engage walls 23B along the height of side edges 28B. Thus it is preferred that insert 26B be constructed so that its bottom edge 38B is only slightly less long than lower diameter 40L and top edge 36B is only slightly less long than greater diameter 40G.

When worker 16 slides insert 26B into place within aerial bucket 14D, sloping side edges 28B of insert 26B substantially abut sloping walls 23B of bucket 14D. Thus insert 26B is held in place by the inward curvature of walls 23B. For example, one shape for an aerial bucket with sloping walls but no inside corners would be a frustum of a cone. Within a frustum-of-a-cone shape, insert's top edge 36B and bottom edge 38B run along diameter 40G and 40L respectively. Within aerial bucket 14, both diameter 40G and 40L are longer than any adjacent parallel line on the same horizontal plane. In other words, walls 23B curve inward as they horizontally move away from diameters 40G and 40L.

Insert 26B can be wedged into aerial bucket 14D because insert 26B's stabilizing width changes between top edge 36B and bottom edge 38B at the same rate that aerial bucket's diameter changes between diameter 40G and 40L. Thus insert 26B is supported along the entire height of its edges 28B and is prevented from falling by the inward curve of walls 23A. In a frustum-of-a-cone shape, insert 26B may be horizontally rotated by worker 16 as appropriate to the work to be performed. However, insert 26B will remain vertical and cannot otherwise be substantially displaced except when worker 16 wishes to lift insert 26B out of aerial bucket 14D.

There are other shapes that have sloping walls but no corners. Insert 26B can be supported by walls 23B of buckets 14D of such shapes, so long as walls 23B curve substantially inward as they horizontally curve away from diameters 40G and 40L and so long as insert 26B is of the proper sloping stabilizing width and is properly placed as described above. For example, if an aerial bucket had the shape of an amoebae, that is an irregular shape for which there is no particular name in the field of geometry, insert 26B could be supported by the walls of such an aerial bucket so long as such a bucket had a greater diameter 40G and a lesser diameter 40L as defined above, and insert 26B had the matching sloping stabilizing width and was placed along those diameters. In such a case, insert 26B would have stabilizing side edges that could stabilizingly engage the walls of such an aerial bucket.

So long as the strength of any model of insert 26 is not compromised, more footrests 34 may be added to maximize the choices for worker 16. Accordingly, depending on the slope of its edges 28B, insert 26B may be wide enough near its top edge 36B to accommodate more footrests than near its bottom edge 38B, as shown in FIGS. 6 through 6B.

Figure 7:
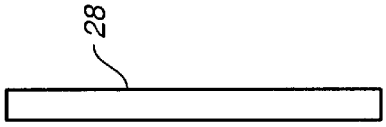
FIG. 7 is a side view of the ergonomic insert of FIG. 5, FIG. 6 and FIG. 9.
Figure 11:
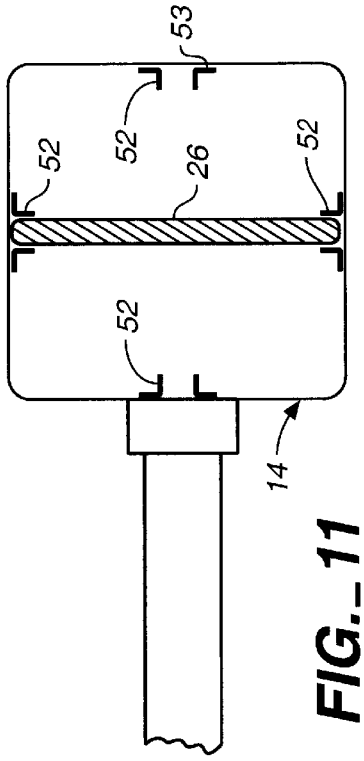
FIG. 11 is a plan view of an ergonomic insert supported by brackets within an aerial bucket according to the present invention.

A generic side view of the ergonomic inserts described above is shown in FIG. 7. This demonstrates that the inserts of FIGS. 3, 5 and 6 may, but do not have to be constructed with the same height and thickness as one another.

Figure 8A:
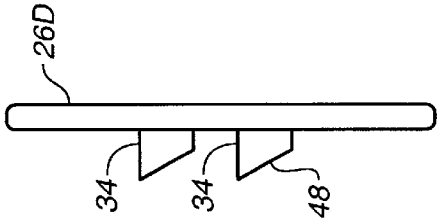
FIG. 8A is a side view of another ergonomic insert according to the present invention.
Figure 8:
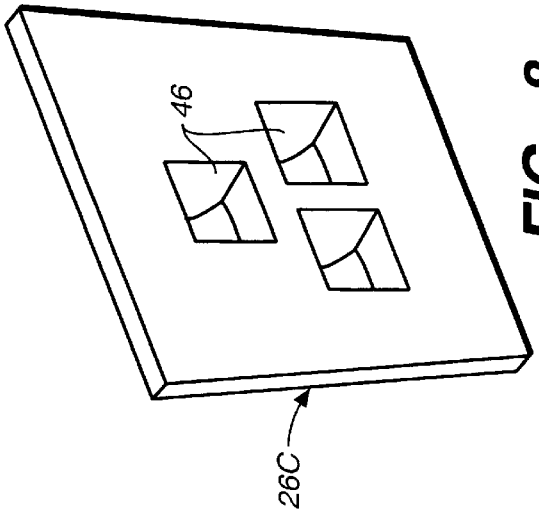
FIG. 8 is a perspective view of an ergonomic insert according to another embodiment of the present invention.

Footrests 34 do not have to be formed from holes 32 within ergonomic insert 26. The following embodiments of the present invention serve as examples of other methods of forming footrests 34 within an ergonomic insert 26. For example, in FIG. 8, insert 26C forms concavities 46 therein to act as footrests 34 rather than holes. Another example is insert 26D shown in FIG. 8A. Insert 26D forms protrusions 48 therein to act as footrests 34 rather than holes or concavities. It is also possible for an ergonomic insert to form concavities 46 on one face as shown in FIG. 8 and protrusions on the other face as shown in FIG. 8A.

Figure 9:
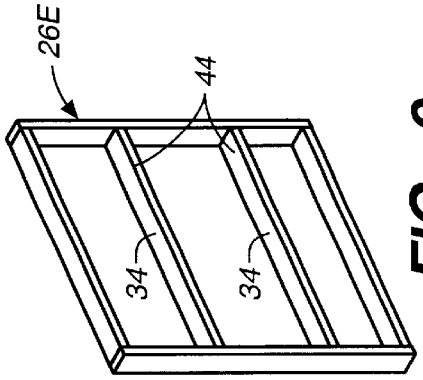
FIG. 9 is a perspective view of another ergonomic insert according to the present invention.

Another embodiment of the present invention is insert 26E of FIG. 9. Insert 26E forms nominally horizontal slats 44 therein to act as footrests 34. A wooden palette board normally used to stack merchandise, when turned on its side and slid into place within an aerial bucket, is a version of this embodiment.

Figure 10:
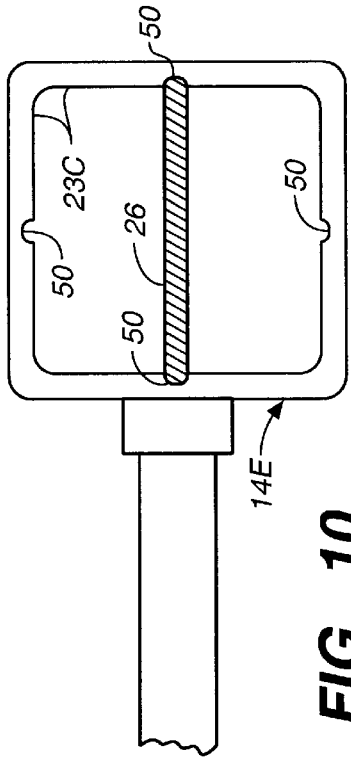
FIG. 10 is a plan view of an ergonomic insert supported by grooves within an aerial bucket according to the present invention.

Each of the above inserts 26A through 26E may be supported in position by the walls of the aerial bucket into which they are placed, as described hereinabove. However, there are alternative methods by which an ergonomic insert may be supported in a vertical position. For example, in FIG. 10 an ergonomic insert 26 is held in place by means of grooves 50 formed in walls 23C of aerial bucket 14E.

Another alternative method of supporting an ergonomic insert 26 within an aerial bucket 14 involves the use of brackets 53. Most aerial buckets are not normally constructed with brackets 53. Thus, brackets 53 would normally be retrofitted into aerial bucket 14 by attaching them to walls 23 with first attaching means 53. Such an attaching means could be any of the variety of attaching means well-known in the art, such as screws, bolts or glue. This after-market improvement enables worker 16 to slide insert 26 into place from above as with the other inserts described above.

Figure 12:
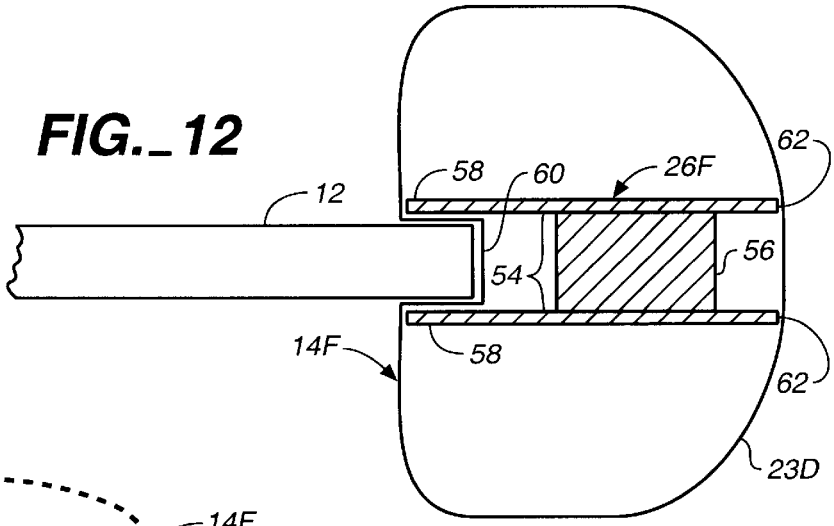
FIG. 12 is a plan view of an ergonomic insert supported by the structure of a kidney-shaped aerial bucket according to another embodiment of the present invention.

In some cases, the present invention may be adapted for use in aerial buckets of irregular shape, even when there is no "diagonal" or "diameter" as defined above, nor grooves or brackets. For example, there are aerial buckets whose walls have an indented wall section 60. An example of such an aerial bucket is the kidney shaped aerial bucket 14F, shown in FIGS. 12 and 12A.

For such an aerial bucket 14F, an insert 26F may be constructed to take advantage of the peculiar shape of its walls 23D. Insert 26F comprises two parallel sheets 54 securely attached to and spaced a stabilizing distance apart from one another by second attaching means 56. A "stabilizing distance apart" is defined to mean that the two sheets are separated sufficiently to allow a first end 58 of sheets 54 closest to boom 12 to partially surround, contact and thus stabilizingly engage indented portion 60 of aerial bucket 14F. Because first end 58 and indented portion 60 stabilizingly engage one another, indented portion 60 acts as a support for insert 26F to stabilize it in a vertical position and prevent it from falling over.

A second end 62 of insert 26F is of such dimensions and is placed within aerial bucket 14F so that second end 62 abuts walls 23D opposite to indented portion 60. Each of the sheets 54 thus runs along a line that is longer than any adjacent parallel line bounded by walls 23D on the side of the sheet facing away from attaching means 56. In such a kidney-shaped bucket, walls 23D curve inward as they curve away from second end 62, thus stabilizing insert 26F and preventing it from falling over.

Figure 12A:
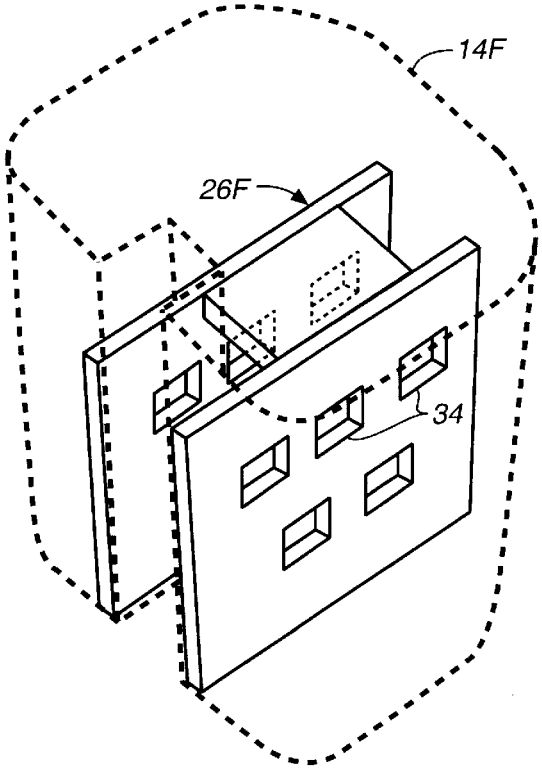
FIG. 12A is a perspective view of the ergonomic insert and aerial bucket of FIG. 12.

As shown in FIG. 12A, insert 26F may have an arbitrary number of footrests 34.

Figure 13:
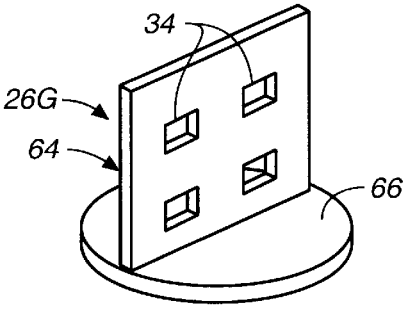
FIG. 13 is a perspective view of an ergonomic insert according to another embodiment of the present invention.
Figure 13A:
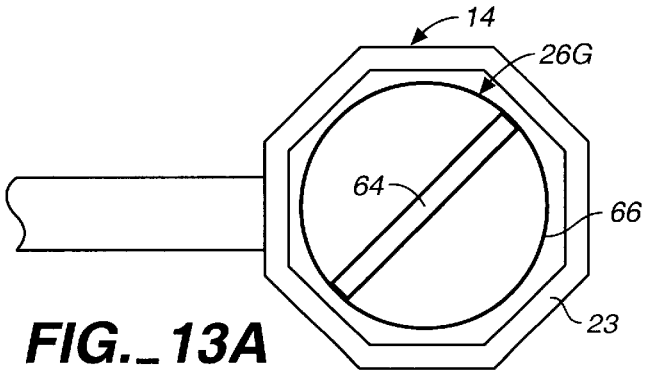
FIG. 13A is a plan view of the ergonomic insert of FIG. 13 within an aerial bucket of arbitrary design.

In aerial buckets 14 that have no internal structure that can support an ergonomic insert 26 in a vertical position, a self-supporting ergonomic insert 26G may be used as shown in FIGS. 13 and 13A. Such a self-supporting ergonomic insert comprises a riser 64 and a self-supporting means 66. Self-supporting means 66 may comprise a pedestal such as the attached circular support shown in FIG. 13.

A circular self-supporting means 66 lends itself more easily to horizontal rotation of riser 64 within aerial bucket 14, maximizing the ability of worker 16 to choose the best orientation in which to perform labor. However, in other embodiments of the present invention, self-supporting means 66 may instead comprise other structures well known in the art, of such shape and strength to support said sheet in an ergonomic position, such as a foot or feet, a leg or legs, a truss or trusses and a strut or struts that attach to and support riser 64.

For reference, FIG. 13 also shows riser 64 with an arbitrary number of footrests 34 formed therein. Footrests 34 could be made in the same form as the footrests in any of the above described inserts 26A through 26E. Placement and use of a self-supporting ergonomic insert would be essentially the same as for the above described ergonomic inserts except, as best shown in FIG. 13A, insert 26G need not engage walls 23 at any point.

Thus, the present invention may be used in any aerial bucket of any shape, even if the shape does not lend itself to providing lateral support to the insert. Indeed, the present invention may be used in any work situation in or out of an aerial bucket where a worker is at risk for lower back strain.

The above descriptions and drawings herein of various types of inserts, footrests, combinations and methods of securing and using ergonomic inserts are examples of the present invention and are not meant to limit the present invention to those descriptions and drawings. Since numerous modifications and changes may occur to those skilled in the art, it is not desired to limit the present invention to the examples shown and described herein. Therefore, it is understood that many modifications and variations could be made without departing from the spirit and scope of the present invention. Accordingly, reference should be made primarily to the accompanying claims rather than the foregoing specification to determine the scope of the present invention.

I claim:

1. An ergonomic inset in combination with an aerial bucket comprising; said aerial bucket having walls and a floor, and stabilizing means stabilizing said insert within the aerial bucket; said ergonomic insert comprising a substantially vertical rectangular panel having a top edge, bottom edge, and vertically extending side edges and a plurality of footrest in a middle portion of the panel, wherein said footrests comprise at least one hole, concavity, or protrusion; said bottom edge engaging the floor and said vertically extending side edges engaging opposite walls of said aerial bucket and bisecting the bucket.

2. The combination of claim 1 wherein said stabilizing means comprises said walls comprising grooves therein for receiving said ergonomic insert.

3. The combination of claim 1 wherein stabilizing means comprises brackets attached to said walls for receiving said ergonomic insert.

4. The combination of claim 1 wherein and said stabilizing means comprises an indented portion integral with said walls for securely engaging said ergonomic insert comprising two sheets spaced a stabilizing distance apart from each other.

5. The combination of claim 1 wherein said stabilizing means comprises said aerial bucket comprising a diameter and said insert comprising a stabilizing width, whereby said width rests on said diameter when said ergonomic insert is placed within said aerial bucket.

6. The combination of claim 1 wherein said aerial bucket comprises a nominally rectangular floor and said ergonomic insert extends along a diagonal of the floor.

7. The combination of claim 1 wherein said aerial bucket comprises a nominally circular floor and said diameter comprises a line that nominally bisects said floor.

8. The combination of claim 1 wherein footrests and holes that may act as an ergonomically positioned footrest.

9. The combination of claim 1 wherein said footrests are concavities that may act as an ergonomically positioned footrest.

10. The combination of claim 1 wherein said footrests are protrusions that may act as an ergonomically positioned footrest.

11. The combination of claim 1 wherein at least one hole is defined by a slot at least one. ergonomically positioned slat.

12. The combination of claim 1 wherein said said top edge provides an additional footrest.

13. The combination of claim 5 wherein said top edge is between one third and two thirds the height of said walls of said aerial bucket.

14. The combination of claim 1 wherein said footrests are positioned on at least two heights.

15. The combination of claim 1 wherein said stabilizing means comprises said vertically extending side edges.

16. The combination of claim 15 wherein said walls of said aerial bucket meet to form at least two diagonally opposite corners and said stabilizing means comprises said side edges stabilizingly engaging said walls at said diagonally opposite corners.

* * * * *